United States Patent [19]

Beyer

[11] Patent Number: 4,956,918

[45] Date of Patent: Sep. 18, 1990

[54] GUIDE BAR FOR THE SAW CHAIN OF A MOTOR-DRIVEN CHAIN SAW

[75] Inventor: Hans-Joachim Beyer, Winnenden, Fed. Rep. of Germany

[73] Assignee: Andreas Stihl, Waiblingen, Fed. Rep. of Germany

[21] Appl. No.: 406,520

[22] Filed: Sep. 13, 1989

[30] Foreign Application Priority Data

Sep. 13, 1988 [DE] Fed. Rep. of Germany ..... 3831110

[51] Int. Cl.[5] ..... B27B 17/04

[52] U.S. Cl. ..... 30/387; 30/385

[58] Field of Search ..... 30/383, 385–387

[56] References Cited

U.S. PATENT DOCUMENTS 4,561,181 12/1985 Weisgerber ..... 30/387

*Primary Examiner*—Douglas D. Watts

*Attorney, Agent, or Firm*—Walter Ottesen

[57] ABSTRACT

The invention is directed to a guide bar for the saw chain of a motor-driven chain saw and includes a base body section on which a nose assembly section for the saw chain is releasably attached. The nose assembly section is attached to the base body section by means of a releasable lock which is not destroyed in order to effect a separation of the two sections. The lock includes an eccentric cam which is rotatable about an axis transverse to the plane of the guide bar. The cam is in contact engagement with a wall of a bore in the guide bar when the cam is in the locked position.

15 Claims, 4 Drawing Sheets

GUIDE BAR FOR THE SAW CHAIN OF A MOTOR-DRIVEN CHAIN SAW

FIELD OF THE INVENTION

The invention relates to a guide bar for the saw chain of a motor-driven chain saw which includes a base body section and a nose assembly section which is releasably attached to the main body section.

BACKGROUND OF THE INVENTION

U.S. Pat. No. 4,561,181 discloses a guide bar of this kind for portable handheld motor-driven chain saws and for work machines such as so-called wood harvesting machines or processors. The nose assembly section for the saw chain defines the forward end of the guide bar and is subjected to large loads during operation. Accordingly, bending forces must be taken up by the guide bar and these forces occur especially during tilting of the forward end. Pressure forces acting on the forward end of the guide bar during plunge-cutting operations and the dynamic directional-change forces of the rapidly moving saw chain are also considerable.

For the above reasons, the nose assembly section defining the forward end of the guide bar becomes worn substantially earlier than the base body section of the guide bar. In known guide bars, the nose assembly section is configured as a separate exchangeable component in order that the entire guide bar need not be discarded after the nose assembly becomes worn. Rivets or other releasable fastening elements which must be destroyed to be removed are used to attach the nose assembly section to the base body section. Accordingly, special tools must be used to destroy the fastening elements when exchanging the nose assembly section and to attach the replacement nose assembly section. This type of retrofit work cannot be carried out by the worker in the forest who is operating the tool or if so, only with a great deal of difficulty. A further disadvantage is seen in that the operator cannot tighten the guide bar connection at the location of use when this connection becomes loose as a consequence of the dynamic forces acting on the guide bar base body section and especially on the nose assembly section.

SUMMARY OF THE INVENTION

It is an object of the invention to provide a guide bar having a base body section and a nose assembly section which avoids the above disadvantages. It is a further object of the invention to provide such a guide bar which permits a quick exchange of the nose assembly section directly at the location where the chain saw is being used without special accessory devices and tools. It is still another object of the invention to provide a guide bar of the above kind wherein the exchange of the nose assembly section can be carried out without difficulty by trained workers.

The guide bar of the invention is for the saw chain of a motor-driven chain saw. The guide bar includes: a base body section; a nose assembly section for changing the direction of the saw chain; and, a releasable locking device for connecting the nose assembly section to the base body section with the locking device being releasable without destroying the same.

BRIEF DESCRIPTION OF THE DRAWINGS

The invention will now be described with reference to the drawings wherein.

Figure 1:
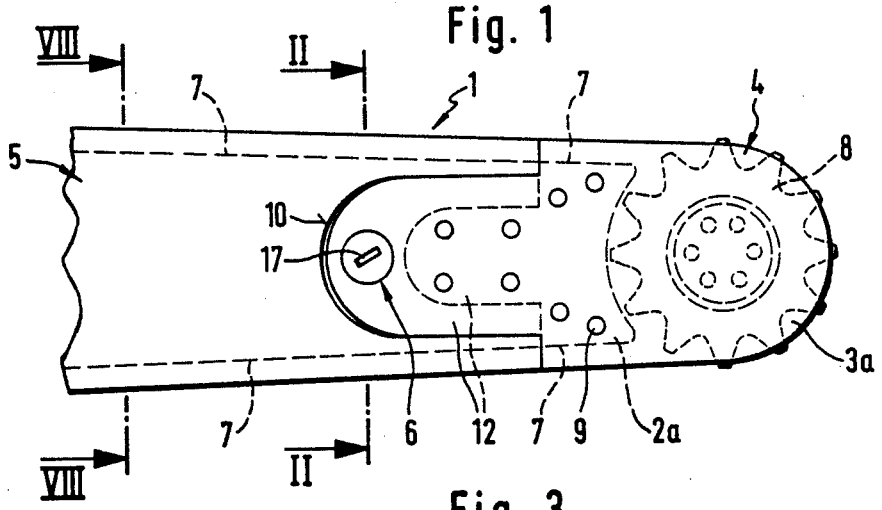
FIG. 1 is a side elevation view of the forward portion of a guide bar according to the invention.
Figure 2:
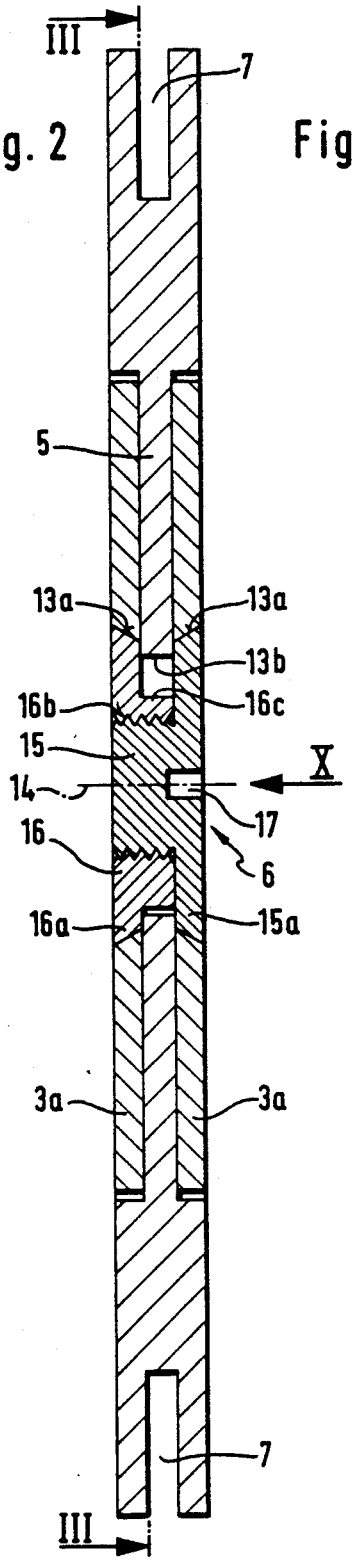
FIG. 2 is an enlarged section view taken along line II—II of FIG. 1.
Figure 8A:
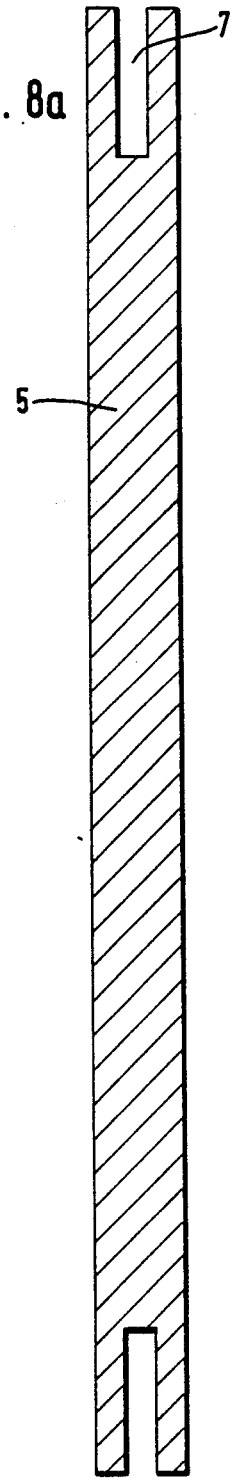
Figure 9:
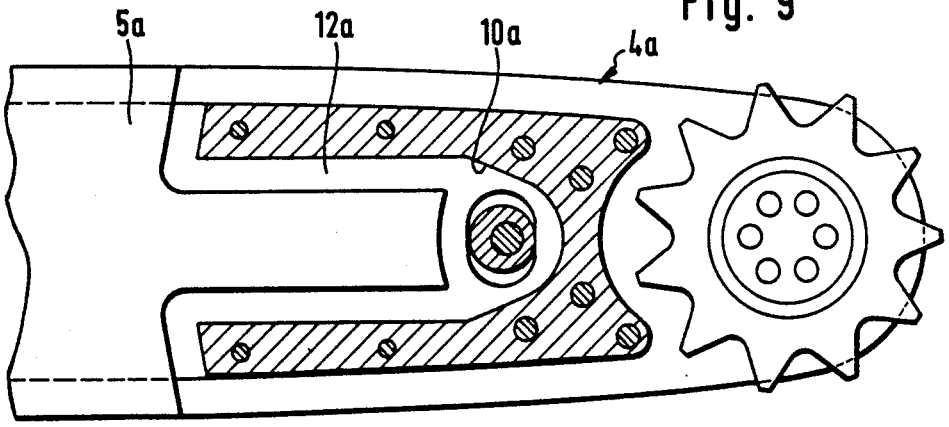
Figure 10:
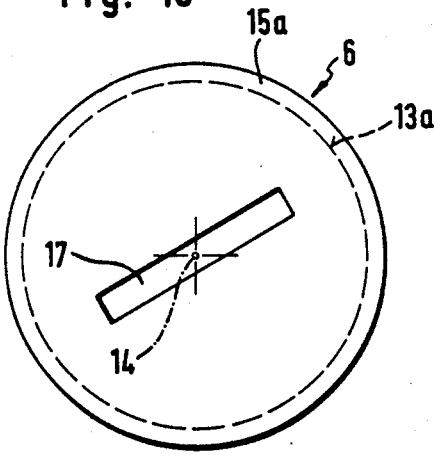
Figure 11:
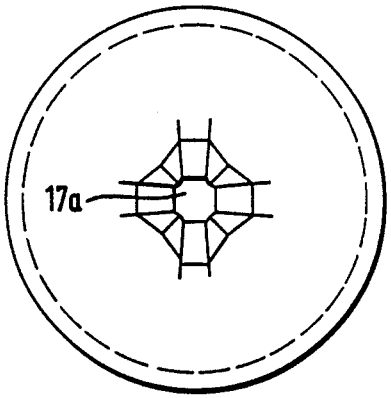
Figure 12:
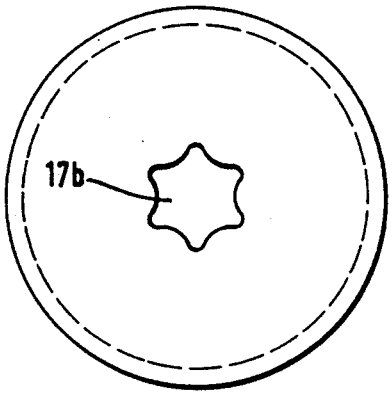
Figure 13:
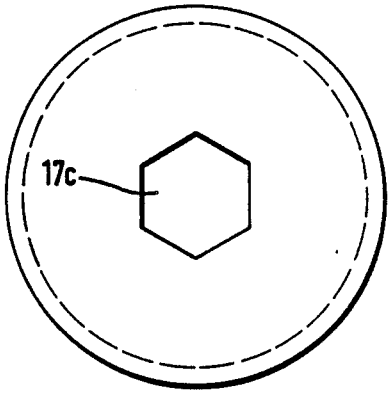

FIG. **8*a* is an enlarged section view taken along line VIII—VIII of FIG. 1** showing a base body section configured as a one-part piece;

FIG. **8*b* is an enlarged section view corresponding to that of FIG. 8*a*** wherein the base body section is configured as a three-layer embodiment;

FIG. 9 is a side elevation view of another embodiment of the guide bar according to the invention wherein the tongue-shaped portion is provided on the base body section with the base body section and the nose assembly section shown in longitudinal section;

FIG. 10 is an enlarged view of an eccentric cam lock for the adjustable coupling of the nose assembly section to the base body section for the guide bar of FIG. 1 with the view of the eccentric cam lock being seen in the direction of arrow X of FIG. 2;

FIG. 11 is an eccentric cam lock corresponding to that of FIG. 10 wherein the lock is equipped with a cross-slot screw attachment;

FIG. 12 is an eccentric cam lock corresponding to that shown in FIG. 10 but equipped with a TORX-screw attachment; and, FIG. 13 is an eccentric cam lock corresponding to that shown in FIG. 10 but equipped with a hexagonal recess attachment.

DESCRIPTION OF THE PREFERRED EMBODIMENTS OF THE INVENTION

The guide bar 1 shown in FIGS. 1 to 7 is for a continuous saw chain (not shown) which runs about the periphery thereof and can be mounted on a portable handheld motor-driven chain saw having an internal combustion engine or an electric motor for driving the saw chain.

Figure 8B:
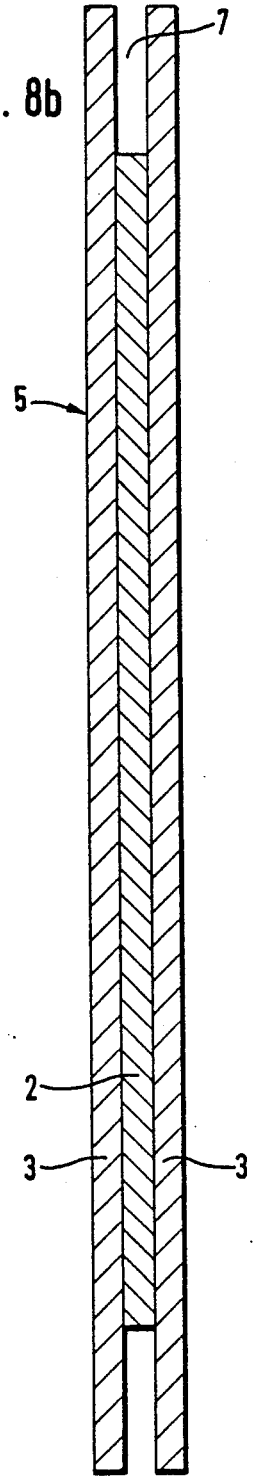

The guide bar comprises a base body section 5 and a separate nose assembly section 4 attached to the base body section. The guide bar can be machined from a single piece as shown in FIGS. 2 and **8*a* for the base body section 5. In the embodiment of FIG. 8*b*, the base body section 5 is a sandwich construction of three layers, namely, the middle layer 2 and two side layers 3 which are configured as sheet metal plates connected tightly to each other and the connection can be effected by rivets or by spot welding. This guide bar 1 has a high degree of strength, especially bending strength. The middle layer 2 is covered by the two side layers 3**.

The nose assembly section 4 is disposed at the forward end of the guide bar 1 and is to be attached to the base body section 5 in a form-tight manner without play. For this purpose, an eccentric cam lock 6 is provided so that the nose assembly section 4 can be quickly exchanged and adjusted without special tools.

A guide slot 7 having a rectangular cross section is formed in the narrow edges of the base body section 5 for guiding the saw chain. The guide slot 7 continues into the narrow edges of the nose assembly section 4. The nose assembly section 4 is a three-layer plate having a middle layer 2*a* and two side layers 3*a*. The nose assembly section 4 can be configured as one piece like the base body section or can likewise comprise three sheet metal plates which are tightly connected to each other by rivets 9.

In the embodiment shown, a sprocket wheel 8 (FIG. 1) is journalled in the middle between the two side layers 3*a*. The direction of the saw chain is changed by approximately 180° by means of the sprocket wheel 8 and is guided in the guide slot 7 which extends over the base body section 5 into the nose assembly section 4 up to the immediate vicinity of the sprocket wheel 8.

A U-shaped opening 10 is provided in the end region of the base body section 5 facing toward the nose assembly section 4 in the embodiment of FIGS. 1 to 7. The U-shaped opening 10 is bounded by a stepped periphery 11. The stepped configuration of the periphery 11 is formed by providing a U-shaped recess in each side of the base body section 5 in the forward region 3*b* thereof. The U-shaped recess is larger than the opening 10 which is disposed in the forward region 2*b* of the base body section 5.

The nose assembly section 4 has a rearwardly extending tongue portion 12 which is stepped in correspondence to the periphery 11 of the opening 10 so that it is seated in the base body section 5 in an essentially form-tight manner and so as to be substantially free of play. The part of the tongue portion 12*b* of the nose assembly section 4 which is configured from the middle layer 2*a* engages in the U-shaped opening 10 of the base body section; whereas, the tongue-shaped portions 12*c* of the side layers 3*a* of the nose assembly section 4 engage in the recesses of the side surfaces of the base body section 5. The tongue-shaped portions 12*c* which are configured from the side layers 3*a* of the nose assembly section 4 therefore engage over the stepped periphery 11 of the base body section 5 in the manner of a groove-and-tongue connection. The bending forces occurring at the nose assembly section 4 during work with the motor-driven chain saw are taken up by the base body section 5 because of the flat surface engagement between the side surfaces of the base body section and the nose assembly section; whereas, pressure forces are conducted into the base body section 5 via the butt joint at the end edges.

As shown in FIG. 9, the groove-and-tongue connection can also be configured in such a manner that the U-shaped opening 10*a* is formed in the nose assembly section 4*a* and the tongue-like projecting part 12*a* is configured on the main body section 5*a*.

Figure 3:
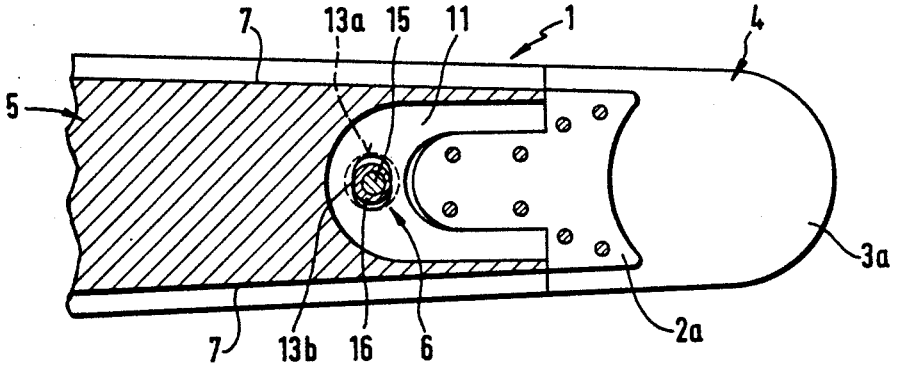
FIG. 3 is a side elevation view, partially in longitudinal section, of the guide bar of FIG. 1 taken along the line III—III of FIG. 2 showing the nose assembly section with one side wall of the nose assembly section and the sprocket wheel and its bearing omitted.
Figure 4:
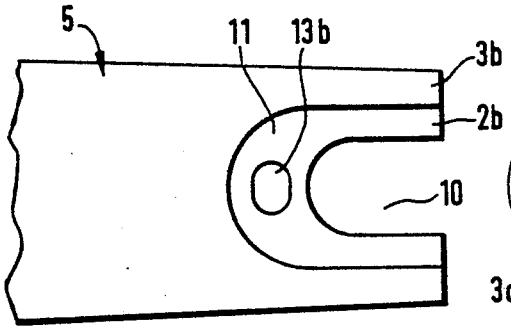
FIG. 4 is a side elevation view of the forward portion of the base body section of the guide bar.
Figure 5:
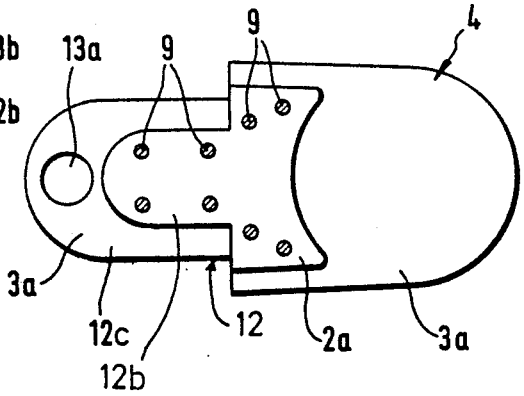
FIG. 5 is a side elevation view of the nose assembly section of the guide bar corresponding to the representation thereof in FIG. 3.

As shown in FIGS. 1 to 3, the eccentric cam lock 6 is preferably provided in the region of the bight portion of the U-shaped stepped peripheral region 11 of the base body section and the bight portion of the tongue-shaped portions of the side layers 3*a* of the nose assembly section 4. For this purpose, the base body section is provided with a through slot 13*b* in the forward region 2*b* and aligned bores 13*a* are provided in the side layers 3*a* of the nose assembly section 4. When the nose assembly section 4 is seated, the eccentric cam lock 6 is placed in the openings 13*a* and 13*b* which are superposed so as to be coincident as shown in FIG. 2. FIGS. 10 to 13 show the eccentric cam lock 6 with different tightening possibilities.

As shown in FIG. 2, the lock 6 comprises essentially a bolt 15 and a locking part 16 and is rotatable about axis 14 lying transversely to the plane of the guide bar. The bolt 15 has a head plate 15*a* which is conically configured in the manner of a counter-sunk screw and is recessed in a correspondingly conically configured bore 13*a* of the plate which defines one of the side layers 3*a*. The bolt 15 is threadably engaged with the eccentric cam locking part 16 and configured in the manner of a locking screw.

The cylindrical eccentric cam body has play in the slot 13*b* of the base body section and in the tightened condition, the eccentric cam body lies with a portion of its peripheral surface against the wall defining the slot 13*b*. In the embodiment of FIG. 10, a slot 17 is provided in the head plate 15*a* of the bolt 15 for receiving a screwdriver or the like therein to enable the eccentric cam lock 6 to be selectively rotated into its locked and opened positions. Recesses (not shown) can be provided in the head plate 16*a* of the lock part for seating a counter-holding tool. In lieu of the slot 17, a cross slot 17*a* can be provided as shown in FIG. 11 for receiving a Phillips screwdriver. On the other hand, a recess 17*b* can be provided as shown in FIG. 12 to accommodate a TORX-head screw or a hexagonal recess 17*c* (FIG. 13) can be provided as a possible configuration for tightening the eccentric cam lock 6.

The peripheral edge of the lock part 16 and/or the bore wall can be configured so as to be essentially smooth whereby an easy rotation of the eccentric cam lock 6 is assured. The difference of the radii of curvature of the eccentric cam and the opening are selected so as to be small in order to prevent an unintentional loosening of the eccentric cam lock 6. In this way, a self-locking is achieved which causes the eccentric cam lock 6 always to remain in the adjusted position even in the presence of vibrations occurring during sawing and bending loads applied to the guide bar 1. However, it is advantageous to coat the peripheral edge of the locking part 16 and/or the bore wall with a friction increasing material or to roughen or serrate the same so that the rotation of the eccentric cam lock 6 is made difficult and an unintentional loosening is precluded even with a larger difference in the radii of curvature.

Figure 6:
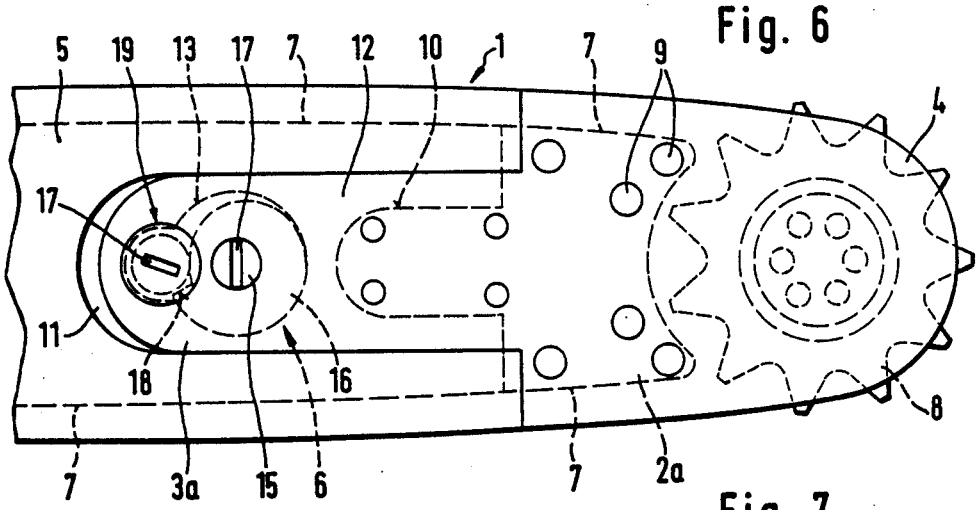
FIG. 6 is a side elevation view of an alternate embodiment of the guide bar of the invention.

In the embodiment shown in FIG. 6, a holding part 19 is provided which can be configured as a bolt or as a screw and can fit into a bore of the guide bar 1 located next to the eccentric cam lock 6. The holding part 19 can likewise be an actuated part configured with a slot 17 for receiving a screwdriver and can be disposed at the outer periphery of the locking part 16 so that the desired clamping connection is produced by rotating the holding part 19 and the eccentric cam locking part 16 in mutually opposite directions. The eccentric cam locking part 16 has a spirally shaped periphery in the embodiment shown so that a stop 18 is formed which limits the rotational movement when tightening.

Figure 7:
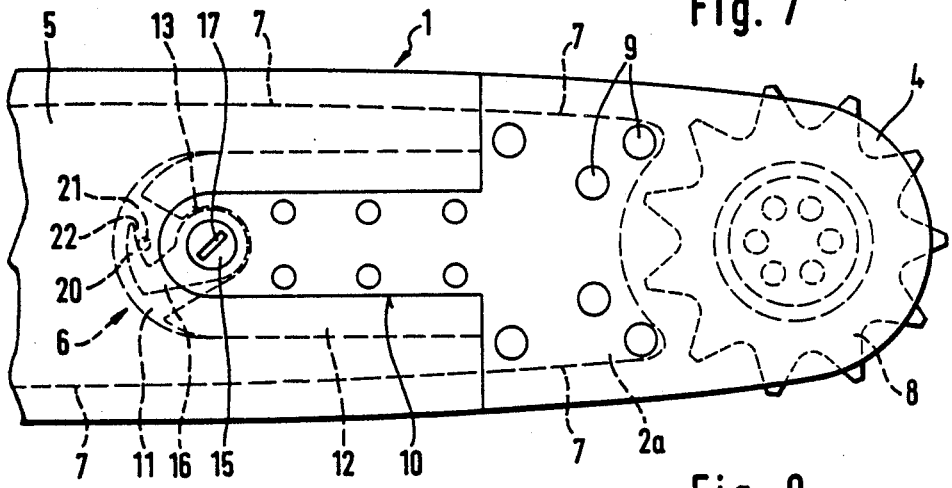
FIG. 7 is a side elevation view of still another alternate embodiment of the guide bar of the invention.

In the embodiment of FIG. 7, the eccentric cam 6 has a locking hook 20 arranged on the bolt 15. A pin 21 is arranged on the base body section 5 in the region of the periphery 11. The locking hook 20 with its inner side configured as a flat 22 engages over the pin 21 in the locking position of the eccentric cam 6. By inserting a screwdriver in the slot 17, the closure hook 20 is pivoted in the clockwise direction and the eccentric cam connection is thereby tightened. The locking hook 20 is pivoted in the counterclockwise direction for releasing the connection for the purpose of exchanging the nose assembly section 4.

The simple exchangeability of the nose assembly section affords the advantage that this work must not be done in a shop and the operator of the saw can hold several nose assembly sections in supply as parts subject to wear and can mount a new nose assembly section at the work location as required. Various nose assembly sections can be selectively used so that the saw can be equipped for different work tasks with the simple exchangeability which requires no shop work being a substantial advantage. In this way, a nose assembly section having a relatively small sprocket wheel can be utilized for removing branches and for similar work in order to hold the danger of kickback to a minimum. On the other hand, a nose assembly section having a larger sprocket wheel 8 can be used for plunge-cutting work.

The bending and pressure forces are transmitted from the nose assembly section to the main body section via the groove-and-tongue connection of these parts. For this reason, the eccentric cam lock 6 must essentially take up only the forces required to hold the two parts together. The endurance of the connection is therefore assured. The eccentric cam lock makes it possible to tighten the connection in a very simple manner.

It is understood that the foregoing description is that of the preferred embodiments of the invention and that various changes and modifications may be made thereto without departing from the spirit and scope of the invention as defined in the appended claims.

What is claimed is:

1. A guide bar for the saw chain of a motor-driven chain saw, the guide bar comprising:
- a base body section;
- a nose assembly section for changing the direction of the saw chain;
- a releasable locking device for connecting said nose assembly section to said base body section with said locking device being releasable without destroying the same; and,
- said releasable locking device including a non-deforming locking member permanently mounted in said guide bar so as to be movable between a release position and a lock position wherein said locking member holds said sections in force-tight engagement with each other.

2. A guide bar for the saw chain of a motor-driven chain saw, the guide bar comprising:
- a base body section;
- a nose assembly section for changing the direction of the saw chain;
- releasable locking device for connecting said nose assembly section to said base body section with said locking device being releasable without destroying the same;
- said base body section and said nose assembly section conjointly defining a flat body defining a plane; and,
- said locking device including eccentric means rotatably mounted in the guide bar so as to be rotatable about an axis transverse to said plane.

3. A guide bar for the saw chain of a motor-driven chain saw, the guide bar comprising:
- a base body section;
- a nose assembly section for changing the direction of the saw chain;
- a releasable locking device for connecting said nose assembly section to said base body section with said locking device being releasable without destroying the same;
- said base body section and said nose assembly section conjointly defining a flat body defining a plane; and,
- said locking device including: a bolt mounted in said guide bar so as to be rotatable about an axis transverse to said plane; bore means formed in the guide bar for accommodating said bolt therein, said bore means being coaxial to said bolt and defining a wall extending transversely to said plane; and, an eccentric cam mounted on said bolt so as to be rotatable therewith between a release position and a lock position wherein said eccentric cam is in contact engagement with said wall.

4. The guide bar of claim 3, said bolt having a threaded stem and said cam having a threaded bore threadably engaged with said threaded stem.

5. The guide bar of claim 4, wherein the guide bar has a sandwich configuration including two side layers and one middle layer sandwiched between said side layers, said bore means including a cam bore formed in the middle layer of said base body section for accommodating said cam therein; said bolt and said cam having respective head plates counter-sunk in corresponding ones of said side layers; and, each of said head plates having a diameter larger than the diameter of said cam bore with said head plates being viewed in the respective outer surfaces of said side layers.

6. The guide bar of claim 3, said locking device being configured so as to cause one of said bolt and said cam to include means formed therein for receiving a work tool to permit a manual actuation of said eccentric cam between said positions.

7. The guide bar of claim 2, further comprising holding means for securing said locking device against an unwanted loosening thereof.

8. The guide bar of claim 7, wherein the guide bar has a sandwich configuration including two side layers and one middle layer sandwiched between said side layers, said holding means being a clamping member rotatably journalled in the guide bar next to said locking device for connecting the three layers of the guide bar.

9. The guide bar of claim 8, said clamping member and said eccentric cam being rotatable in mutually opposite directions for clamping said clamping member and said eccentric cam against each other; and, said eccentric cam having a stop formed thereon for limiting the rotational movement.

10. The guide bar of claim 8, said locking device having a pin mounted in the guide bar and said clamping member having a flat formed thereon; and, said flat engaging said pin when said clamping member is rotated to engage said pin.

11. The guide bar of claim 10, said clamping member including a locking hook and said flat being formed on said hook.

12. The guide bar of claim 2, wherein the guide bar has a sandwich configuration including two side layers and one middle layer sandwiched between said side layers, said base body section and said nose assembly section conjointly defining an interface; groove-and-tongue connection means formed at said interface for connecting said layers in a form-tight manner without play; and, said locking device being disposed in the region of said connection means.

13. The guide bar of claim 2, said base body section having an approximately U-shaped opening formed therein and said nose assembly section having a tongue-like projection formed thereon for engaging said U-shaped opening in a form-tight manner when said sections are connected to each other.

14. The guide bar of claim 1, said nose assembly section having an opening formed therein and said base body section having a tongue-like projection formed thereon for engaging said opening in a form-tight manner when said sections are connected to each other.

15. A guide bar for the saw chain of a motor-driven chain saw, the guide bar comprising:

a base body section;

a nose assembly section for changing the direction of the saw chain;

a releasable locking device for connecting said nose assembly section to said base body section with said locking device being releasable without destroying the same; and, said locking device including non-deforming cam means permanently mounted in said guide bar for movement between a release position and a cammed position wherein said sections are held in force-tight engagement with each other.

* * * * *